US008334728B2

(12) United States Patent
Washiro

(10) Patent No.: US 8,334,728 B2
(45) Date of Patent: Dec. 18, 2012

(54) HIGH-FREQUENCY COUPLER AND COMMUNICATION DEVICE

(75) Inventor: Takanori Washiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 297 days.

(21) Appl. No.: 12/778,452

(22) Filed: May 12, 2010

(65) Prior Publication Data

US 2010/0327997 A1 Dec. 30, 2010

(30) Foreign Application Priority Data

Jun. 30, 2009 (JP) ..... 2009-156301

(51) Int. Cl.
*H01P 5/00* (2006.01)
*H01Q 9/16* (2006.01)

(52) U.S. Cl. ..... 333/24 R; 343/793

(58) Field of Classification Search ..... 333/24 R; 455/41.1, 282; 343/793, 850, 906
See application file for complete search history.

(56) References Cited

U.S. PATENT DOCUMENTS

2008/0076351 A1 3/2008 Washiro
2009/0121949 A1 * 5/2009 Washiro ..... 343/702

FOREIGN PATENT DOCUMENTS

JP 2008-99236 4/2008

OTHER PUBLICATIONS

U.S. Appl. No. 12/787,669, filed May 26, 2010, Kato, et al.

* cited by examiner

*Primary Examiner* — Dean O Takaoka
(74) *Attorney, Agent, or Firm* — Oblon, Spivak, McClelland, Maier & Neustadt, L.L.P.

(57) ABSTRACT

A high-frequency coupler is provided to include a resonator wherein an infinitesimal dipole is formed, the infinitesimal dipole including a line segment which connects the center of electric charge accumulated in the coupling electrode and the center of mirror-electric charge accumulated in the ground, and the high-frequency signal is transmitted to another high-frequency coupler at a communication partner side, which is placed opposite the high-frequency coupler so that the angle between the direction of the infinitesimal dipole and the direction from the high-frequency coupler toward the other high-frequency coupler is nearly zero.

8 Claims, 13 Drawing Sheets

HIGH-FREQUENCY COUPLER AND COMMUNICATION DEVICE

BACKGROUND OF THE INVENTION

1. Field of the Invention

The present invention relates to a high-frequency coupler and a communication device, which are used for a communication apparatus used for performing large-capacity data transmission over a short distance by using a weak UWB communication scheme in which a high-frequency wideband is used. Especially, the present invention relates to a high-frequency coupler and a communication device, which can be incorporated in and used by a small device such as a handheld device and be fabricated in a small size and at a low price.

2. Description of the Related Art

Noncontact communication is widely used as a way of communicating value information such as authentication information and electronic money or the like. Recently, as a further application of noncontact communication, large-capacity data transmission such as downloading of moving images or music and streaming video or music has been considered.

As a close proximity wireless transfer technology applicable to high-speed communication, "TransferJet" (registered trademark) using a weak ultra-wideband (UWB) signal can be cited (for example, refer to Japanese Unexamined Patent Application Publication No. 2008-99236 and URL: www.transferjet.org/en/index.html (as of Jun. 23, 2009)). The close proximity wireless transfer technology (TransferJet) is basically a scheme in which a signal is transmitted by using the coupling action of an induction electric field. A communication device which uses the close proximity wireless transfer technology includes a communication circuit section configured to perform high-frequency signal processing, a coupling electrode configured to be separately placed at a certain height from the ground, and a resonance section configured to efficiently supply a high-frequency signal to the coupling electrode. The coupling electrode or a component which includes the coupling electrode and the resonance section is also called a "high-frequency coupler" in the present specification.

The close proximity wireless transfer system can be configured as a pair of a reader/writer (initiator) used for transmitting a request command and a transponder (target) used for transmitting a reply command back, in the same way as near-field communication (NFC) of the related art (the NFC is standardized as ISO/IEC IS 18092).

The transponder end is supposed to be incorporated in and used by a small device such as a handheld device. Therefore, it is desirable to fabricate the high-frequency coupler in a small size and at a low price.

SUMMARY OF THE INVENTION

It is desirable to provide a superior high-frequency coupler and a superior communication device, which are used for a communication device used for performing large-capacity data transmission over a short distance by using a weak UWB communication scheme in which a high-frequency wideband is used.

Furthermore, it is desirable to provide a high-frequency coupler and a communication device, which can be incorporated in and used by a small device such as a handheld device and be fabricated in a small size and at a low price. Furthermore, it is desirable to provide a high-frequency coupler and a communication device, whose heights are lowered and whose coupling electrodes are miniaturized, while maintaining the frequency characteristics of the high-frequency coupler and the communication device, and which can suppress unnecessary radio emission when close proximity wireless transfer is performed.

According to a first embodiment of the present invention, there is provided a high-frequency coupler including ground, a coupling electrode configured to be supported so that the coupling electrode is placed opposite the ground and separately placed at a height from the ground, the height being negligible with respect to the wavelength of a high-frequency signal, a resonance section configured to increase electric current which enters the coupling electrode through a transmission path, and a stretchable and retractable connection section configured to connect a predetermined position on the coupling electrode and the resonance section, wherein an infinitesimal dipole is formed, the infinitesimal dipole including a line segment which connects the center of electric charge accumulated in the coupling electrode and the center of mirror electric charge accumulated in the ground, and the high-frequency signal is transmitted to another high-frequency coupler at a communication partner side, which is placed opposite the high-frequency coupler so that the angle $\theta$ between the direction of the infinitesimal dipole and the direction from the high-frequency coupler toward the other high-frequency coupler is nearly zero degrees. According to the first embodiment of the present invention, since the coupling electrode and the resonance section are connected through the stretchable and retractable connection section, the high-frequency coupler can be resistant to deformation based on a load and fabricated in a small size and at a low price. Therefore, the high-frequency coupler can be incorporated in and used by a small device such as a handheld device.

According to a second embodiment of the present invention, there is provided the high-frequency coupler according to the first embodiment, wherein the connection section includes a leaf spring whose cross-section is approximately V-shaped, the connection section is connected to the coupling electrode by using one end of the leaf spring, and the connection section is connected to the resonance section by using the other end of the leaf spring. According to the second embodiment of the present invention, since the coupling electrode is configured to be supported by using a member such as a shield finger, the high-frequency coupler can be manufactured in a small size and at a low price. Therefore, the high-frequency coupler can be suitably incorporated in a small device such as a handheld device.

According to a third embodiment of the present invention, there is provided the high-frequency coupler according to the first embodiment, wherein the cross-section of the connection section includes a pogo pin, the cross-section is connected to the coupling electrode by using one end of the pogo pin, and the connection section is connected to the resonance section by using the other end of the pogo pin. According to the third embodiment of the present invention, since the coupling electrode is configured to be supported by using a member such as a pogo pin, the high-frequency coupler can be manufactured in a small size and at a low price. Therefore, the high-frequency coupler can be suitably incorporated in a small device such as a handheld device.

According to a fourth embodiment of the present invention, there is provided the high-frequency coupler according to any one of the second and the third embodiments, wherein a circuit board where the ground and the resonance section are implemented is arranged on an inner surface of a first housing member of a portable device, and one end of the connection section is attached to the resonance section, and a conductor pattern, which functions as the coupling electrode, is formed on an inner surface of a second housing member of the portable device. According to the fourth embodiment of the present invention, by putting the two housing members together so that the openings of the two housing members are closed, the coupling electrode can be supported so that the coupling electrode is separately placed at a height from the circuit board (ground). Therefore, unnecessary radio emission can be suppressed. In addition, since the shield finger and the pogo pin are stretchable and retractable, it is difficult for the connection section to be bent and destroyed even if a load is applied to the supporting member through the housing member.

According to a fifth embodiment of the present invention, there is provided the high-frequency coupler according to the fourth embodiment, wherein the other end of the connection section has direct contact with the predetermined position on the coupling electrode and the resonance section is connected to the coupling electrode, in the state in which the first housing member is closed by using the second housing member and a chassis is assembled. According to the fifth embodiment of the present invention, by putting the two housing members together so that the openings of the two housing members are closed, the coupling electrode can be supported so that the coupling electrode is separately placed at a height from the circuit board (ground). Therefore, unnecessary radio emission can be suppressed. In addition, since the shield finger and the pogo pin are stretchable and retractable, it is difficult for the connection section to be bent and destroyed even if a load is applied to the supporting member through the housing member.

According to a sixth embodiment of the present invention, there is provided the high-frequency coupler according to the second embodiment, wherein with respect to the connection section, the one end of the leaf spring whose cross-section is approximately V-shaped is placed approximately immediately above the other end of the leaf spring and connected approximately to the center of the coupling electrode. According to the sixth embodiment of the present invention, since, with respect to the connection section, the one end of the leaf spring whose the cross-section is approximately V-shaped is placed approximately immediately above the other end of the leaf spring and connected to the coupling electrode, action which cancels out electric current flows flowing horizontally along the leaf spring can be realized most effectively. In addition, since the one end of the leaf spring is connected approximately to the center of the coupling electrode, an unnecessary electric wave which is emitted from the surface of the coupling electrode can be suppressed.

According to a seventh embodiment of the present invention, there is provided the high-frequency coupler according to the second embodiment, wherein the combined length of the leaf spring and the coupling electrode approximately corresponds to a quarter of the wavelength of an operating frequency. According to the seventh embodiment of the present invention, since the combined length of the leaf spring and the coupling electrode approximately corresponds to a quarter of the wavelength of the operating frequency, the height of the high-frequency coupler can be lowered and the coupling electrode can be miniaturized, while maintaining the resonance characteristic.

According to an eighth embodiment of the present invention, there is provided a communication device including ground, a coupling electrode configured to be supported so that the coupling electrode is placed opposite the ground and separately placed at a height from the ground, the height being negligible with respect to the wavelength of a high-frequency signal, a resonance section configured to increase electric current which enters the coupling electrode through a transmission path, a stretchable and retractable connection section configured to be attached to the resonance section by using one end of the stretchable and retractable connection section and to connect a predetermined position on the coupling electrode and the resonance section, a first housing member configured to include a circuit board where the ground and the resonance section are implemented and which is arranged on an inner surface of the first housing member, and a second housing member configured to include a conductor pattern which functions as the coupling electrode and is formed on an inner surface of the second housing member, wherein the other end of the connection section has direct contact with the predetermined position on the coupling electrode and the resonance section is connected to the coupling electrode, in the state in which the first housing member is closed by using the second housing member, and an infinitesimal dipole is formed, the infinitesimal dipole including a line segment which connects the center of electric charge accumulated in the coupling electrode and the center of mirror electric charge accumulated in the ground, and the high-frequency signal is transmitted to another high-frequency coupler at a communication partner side, which is placed opposite a high-frequency coupler so that the angle θ between the direction of the infinitesimal dipole and the direction from the high-frequency coupler toward the other high-frequency coupler is nearly zero degrees. According to the eighth embodiment of the present invention, since the coupling electrode and the resonance section are connected through the stretchable and retractable connection section, the high-frequency coupler can be resistant to deformation based on a load and fabricated in a small size and at a low price. Therefore, the high-frequency coupler can be incorporated in and used by a small device such as a handheld device. According to the eight embodiment of the present invention, by putting the two housing members together so that the openings of the two housing members are closed, the coupling electrode can be supported so that the coupling electrode is separately placed at a height from the circuit board (ground). Therefore, unnecessary radio emission can be suppressed. In addition, since the shield finger and the pogo pin are stretchable and retractable, it is difficult for the connection section to be bent and destroyed even if a load is applied to the supporting member through the housing member.

Further objects, features, and advantages of the embodiments of the present invention will become apparent with reference to detailed descriptions based on the following embodiments of the present invention and attached figures.

DESCRIPTION OF THE PREFERRED EMBODIMENTS

Hereinafter, preferred embodiments of the present invention will be described in detail with reference to figures.

First, an operating principle of close proximity wireless transfer in which a weak UWB communication scheme is used will be described.

Figure 1:
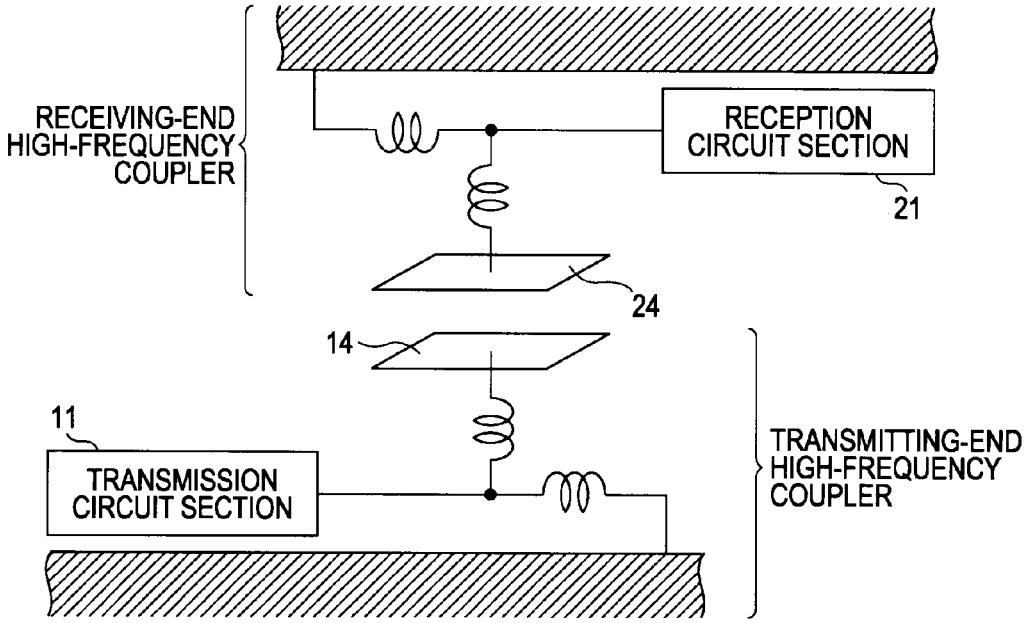
FIG. 1 is a diagram schematically illustrating a configuration of a close proximity wireless transfer system which uses a weak UWB communication scheme.

FIG. 1 is a diagram schematically illustrating a configuration of the close proximity wireless transfer system based on a weak UWB communication scheme in which an electric field coupling action is used. In FIG. 1, coupling electrodes 14 and 24, which a transmitter 10 and a receiver 20 include respectively, are used for transmitting and receiving. Then, the coupling electrodes 14 and 24 are placed opposite each other and separately placed at a distance from each other, the distance being, for example, 3 cm (or about one half of the wavelength of an operating frequency band). When a request to send is generated by an upper application, a transmission circuit section 11 at a transmitter end generates a high-frequency transmission signal such as a UWB signal on the basis of transmission data and transmits the high-frequency transmission signal, as an electric field signal, from a transmission electrode 14 to a reception electrode 24. Then, a reception circuit section 21 at the receiver 20 performs demodulation processing and decoding processing on the received high-frequency electric field signal and transfers the reproduced data to an upper application.

When UWB is used in the close proximity wireless transfer, ultrahigh-speed data transmission whose transmission rate approximately corresponds to 100 Mbps can be realized. In addition, in the close proximity wireless transfer, a radiation electric field is not used but a coupling action of an electrostatic field or a coupling action of an induction electric field is used, as described hereinafter. The strength of the electric field is in inverse proportion to the cube or the square of the distance. Therefore, by controlling the strength of the electric field over a distance of 3 m from a wireless facility to be less than or equal to a predetermined level, in the close proximity wireless transfer system, very weak radio waves can be emitted and hence the licensing of a radio station becomes unnecessary. Therefore, an inexpensive close proximity wireless transfer system can be implemented. In addition, in the close proximity wireless transfer, since data communication is performed by using an electric field coupling scheme, reflected waves from a neighboring reflector are small and hence the effect of interference is advantageously small. Further, it is also not necessary to take into consideration prevention of hacking of a transmission path and securing of confidentiality.

In contrast, in wireless communication, the propagation loss increases with the propagation distance dependent on the wavelength. In the close proximity wireless transfer which uses a high-frequency wideband signal, such as a UWB signal, a communication distance of approximately 3 cm corresponds to approximately one-half of the wavelength of an operating frequency. Thus, even though such a distance is very short, it is difficult for the distance to be neglected and it is necessary to keep the propagation loss at a sufficiently low level. In particular, the characteristic impedance causes a more serious problem in a higher-frequency circuit than in a lower-frequency circuit. Therefore, an impedance mismatch at a coupling point between electrodes of a transmitter and a receiver has a more striking effect in a higher-frequency circuit.

For example, in the close proximity wireless transfer system shown in FIG. 1, even in the case where a high-frequency signal transmission path connecting the transmission circuit section 11 to the transmission electrode 14 is a coaxial line with a matched impedance of, for example, 50Ω, in the case of an impedance mismatch in a coupling portion between the transmission electrode 14 and the reception electrode 24, an electric field signal is reflected to incur propagation loss and hence communication efficiency decreases.

Figure 2:
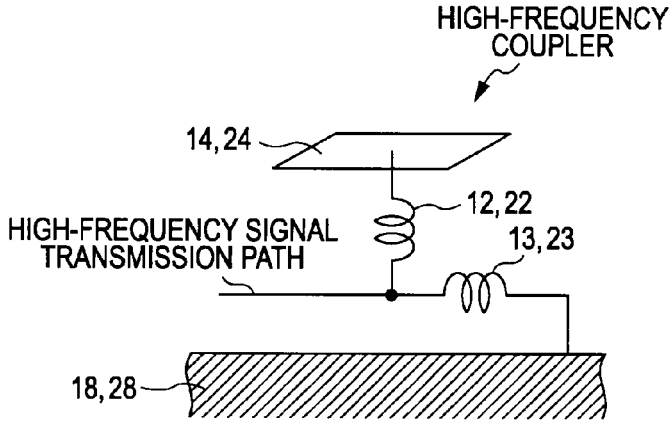
FIG. 2 is a diagram illustrating a basic structure of high-frequency couplers arranged in a transmitter and a receiver respectively.

Then, as shown in FIG. 2, high-frequency couplers arranged in the transmitter 10 and in the receiver 20 include resonance sections respectively, which are connected to the high-frequency signal transmission path. Then, the resonance sections include the electrodes 14 and 24 in a plate shape, series inductors 12 and 22, and parallel inductors 13 and 23, respectively. The high-frequency signal transmission path mentioned here can be configured by using a coaxial cable, a microstrip line, a coplanar line, or the like. In the case where the high-frequency couplers above-mentioned are arranged facing each other, the coupling portion operates as a band-pass filter over a very short distance where a quasi-electrostatic field is dominant. Therefore, a high-frequency signal can be transmitted. In addition, even over a very short distance where an induction electric field is dominant and which is not neglected with respect to the wavelength of an operating frequency, through an induction electric field generated from an infinitesimal dipole (described hereinafter) which is formed by electric charge and mirror electric charge accumulated in the coupling electrode and the ground respectively, a high-frequency signal can be transmitted efficiently between the two high-frequency couplers.

If it is only necessary to achieve impedance matching and to suppress reflected waves, between the electrodes of the transmitter 10 and the receiver 20, that is, in the coupling portion, it is sufficient for the couplers to have simple structures in which the plate-shaped electrodes 14 and 24 and the series inductors 12 and 22 are connected to the high-frequency signal transmission path, respectively and the impedance in the coupling portion can be designed to be continuous. However, there is no change in the characteristic impedance before and after the coupling portion, and hence the magnitude of electrical current does not change either. In contrast, by providing the parallel inductors 13 and 23, a larger amount of electric charge is supplied to the coupling electrode 14, and hence an intensive electric field coupling action can be generated between the coupling electrodes 14 and 24. In addition, when a large electric field is induced near the surface of the coupling electrode 14, the induced electric field is propagated from the surface of the coupling electrode 14 as an electric field signal which is a longitudinal wave and oscillates along the propagation direction (the direction of the infinitesimal dipole, described hereinafter). Owing to the electric field wave, an electric field signal can be transmitted even when the distance (phase length) between the coupling electrodes 14 and 24 is a relatively large distance.

To summarize the conditions mentioned above, in the close proximity wireless transfer system using the weak UWB communication scheme, conditions that are necessary for the high-frequency couplers are as follows:

(1) an electrode used for establishing electric-field coupling is placed opposite the ground and separately placed at a distance from the ground, the distance being negligible with respect to the wavelength of the high-frequency signal;

(2) a resonance section used for establishing stronger electric-field coupling is provided; and (3) the constants of the series inductor and the parallel inductor, the constant of a capacitor due to the coupling electrode, and the length of a stub are set so that the impedance matching can be achieved in a frequency band used for communication in the case where the coupling electrodes are placed facing each other.

In the close proximity wireless transfer system as shown in FIG. 1, when the coupling electrodes 14 and 24 in the transmitter 10 and the receiver 20 are arranged facing each other and separately at a suitable distance from each other, the two high-frequency couplers operate as a band-pass filter which allows an electric field signal in a desired high-frequency range to pass and the single high-frequency coupler operates as an impedance conversion circuit configured to amplify electric current. Therefore, the electric current whose amplitude is large enters the coupling electrode. In contrast, in the case where the high-frequency coupler is placed in free space, the input impedance of the high-frequency coupler does not match the characteristic impedance of the high-frequency signal transmission path. As a result, a signal entering the high-frequency signal transmission path is reflected in the high-frequency coupler and is not emitted to the outside. Therefore, waves interfering with other neighboring systems are not generated. Namely, the transmitter does not continuously emit radio waves in the absence of a communication partner. Only when the communication partner approaches the transmitter, is impedance matching achieved, whereby a high-frequency electric field signal is transmitted.

Figure 3:
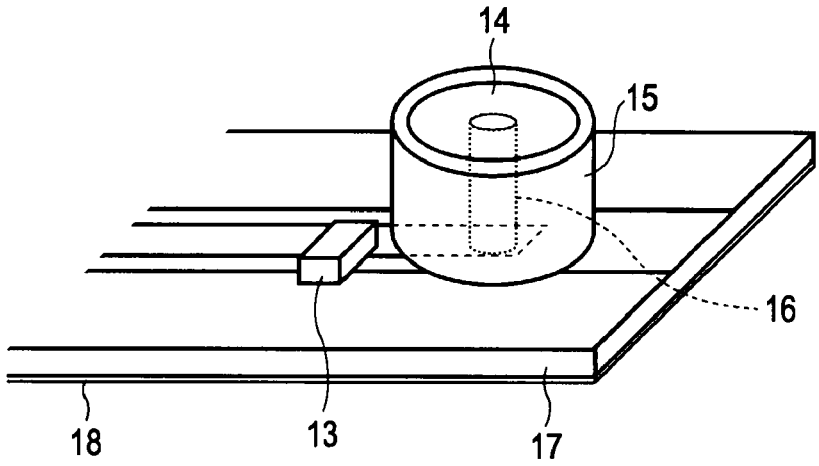
FIG. 3 is a diagram illustrating an example of implementation of the high-frequency coupler shown in FIG. 2.

FIG. 3 is a diagram illustrating an example of implementation of the high-frequency coupler shown in FIG. 2. Either one of high-frequency couplers in the transmitter 10 and the receiver 20 can be configured in the same way. In FIG. 3, the coupling electrode 14 is disposed on the upper surface of a spacer 15 and is electrically connected to a high-frequency signal transmission path on a printed-circuit board 17 via a through-hole 16 penetrating through the spacer 15. While, in FIG. 3, the spacer 15 is approximately cylindrical and the coupling electrode 14 is approximately circular, the shapes of the spacer 15 and the coupling electrode 14 are not limited to specific shapes.

For example, after the through-hole 16 is formed in a dielectric of a predetermined height, the through-hole 16 is filled with conductor and a conductive pattern serving as the coupling electrode 14 is evaporated on the upper end face of the dielectric by using a plating technique. In addition, a wiring pattern serving as a high-frequency transmission line is formed on the printed-circuit board 17. Then, the high-frequency coupler can be fabricated by mounting the spacer 15 on the printed-circuit board 17 by reflow soldering or the like. The height from a circuit mounting surface of the printed-circuit board 17 (or ground 18) to the coupling electrode 14, that is, the length of the through-hole 16 (phase length), is adjusted appropriately in accordance with the operating wavelength to allow the through-hole 16 to have an inductance, which can therefore replace the series inductor 12 shown in FIG. 2. In addition, the high-frequency signal transmission path is connected to the ground 18 via the parallel inductor 13 having a chip shape.

Here, an electromagnetic field generated at the coupling electrode 14 of the transmitter 10 will be examined.

As shown in FIGS. 1 and 2, the coupling electrode 14 is connected to one end of the high-frequency signal transmission path. Then, a high-frequency signal output from the transmission circuit section 11 flows into the coupling electrode 14 and electric charge is accumulated in the coupling electrode 14. At this time, the resonant action of the resonance section including the series inductor 12 and the parallel inductor 13 amplifies the electric current which flows into the coupling electrode 14 through the transmission path and a larger amount of electric charge is accumulated.

In addition, the ground 18 is separately arranged at a height (phase length), which is negligible with respect to the wavelength of the high-frequency signal, from the coupling electrode 14 so that the coupling electrode 14 and the ground 18 face each other. Then, when, as described above, electric charge is accumulated in the coupling electrode 14, mirror electric charge is accumulated in the ground 18. When point charge Q is placed outside a planar conductor, mirror electric charge-Q (virtual charge substituting surface charge distribution) is disposed in the planar conductor. This is also described in Tadashi Mizoguchi "Denjiki gaku" (Electromagnetism) (published by Shokabo Publishing Co., Ltd., pp. 54-57).

As a result of the above-mentioned accumulation of the point charge Q and the mirror electric charge-Q, an infinitesimal dipole is formed, the infinitesimal dipole including a line segment which connects the center of electric charge accumulated in the coupling electrode 14 and the center of mirror electric charge accumulated in the ground 18. Strictly speaking, the point charge Q and the mirror electric charge-Q have volume and the infinitesimal dipole is formed to connect the center of the electric charge and the center of mirror electric charge. The "infinitesimal dipole" mentioned here refers to an "electric dipole whose distance between charges is very short". For example, the "infinitesimal dipole" is described in Yasuto Mushiake, "Antenna.Denpa Denpan (Antenna.Radio-Wave Propagation)" (published by Corona Publishing Co., Ltd., pp. 16-18). Then, owing to the infinitesimal dipole, a transverse wave component $E_\theta$ of an electric field, a longitudinal wave component $E_R$ of an electric field, and a magnetic field $H_\phi$ around the infinitesimal dipole are generated.

Figure 4:
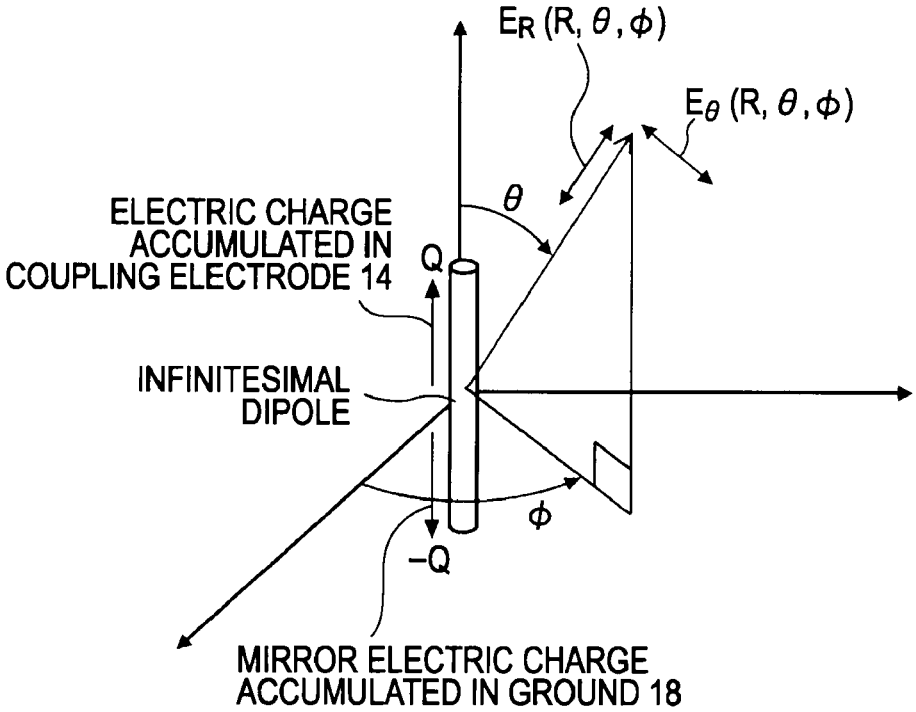
FIG. 4 is a diagram illustrating an electric field based on an infinitesimal dipole.
Figure 5:
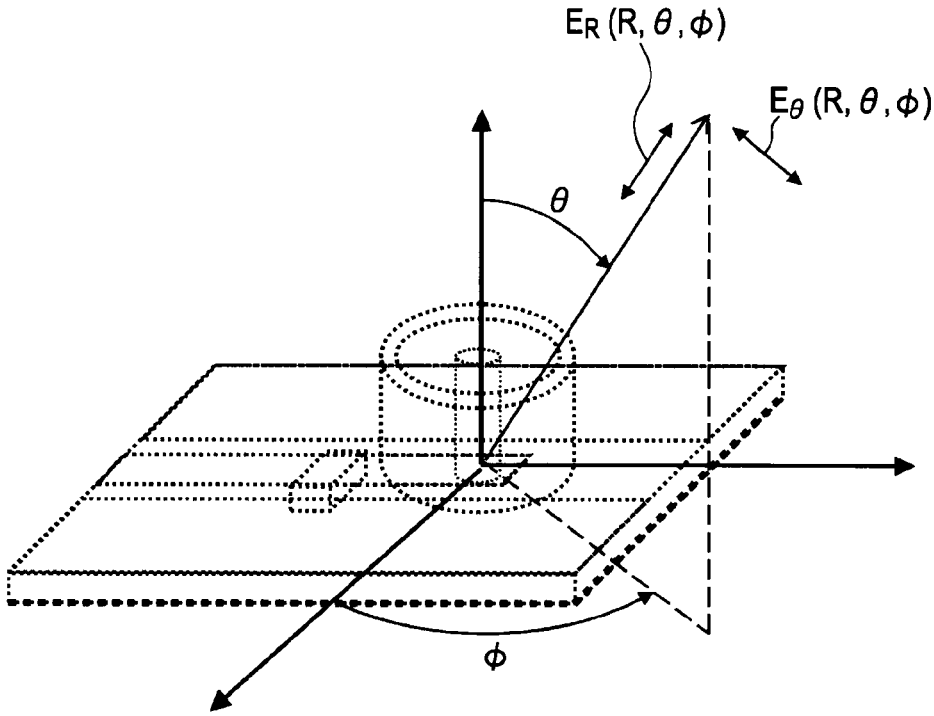
FIG. 5 is a diagram in which the electric field shown in FIG. 4 is mapped above a coupling electrode.

In FIG. 4, an electric field based on an infinitesimal dipole is illustrated. In addition, in FIG. 5, the electric field mapped above a coupling electrode is illustrated. As shown in the diagrams, the transverse wave component $E_\theta$ of an electric field oscillates in a direction perpendicular to the direction of propagation and the longitudinal wave component $E_R$ of an electric field oscillates in a direction parallel to the direction of propagation. In addition, the magnetic field $H_\phi$ is also generated around the infinitesimal dipole. The following equations (1) to (3) represent an electromagnetic field induced by an infinitesimal dipole. In the equations, a component in inverse proportion to the cube of the distance corresponds to an electrostatic field, a component in inverse proportion to the square of the distance corresponds to an induction electric field, and a component in inverse proportion to the distance corresponds to a radiation electric field.

$$E_\theta = \frac{pe^{-jkR}}{4\pi\varepsilon}\left(\frac{1}{R^3} + \frac{jk}{R^2} - \frac{k^2}{R}\right)\sin\theta \tag{1}$$

-continued $$E_R = \frac{pe^{-jkR}}{2\pi\varepsilon}\left(\frac{1}{R^3} + \frac{jk}{R^2}\right)\cos\theta \tag{2}$$

$$H_\phi = \frac{j\omega pe^{-jkR}}{4\pi}\left(\frac{1}{R^2} + \frac{jk}{R}\right)\sin\theta \tag{3}$$

In order to suppress waves interfering with a neighboring system in the close proximity wireless transfer system shown in FIG. 1, it is desirable to use the longitudinal wave $E_R$ including no radiation electric field component while suppressing the transverse wave $E_\theta$ including the radiation electric field component. This is because, as can be expected from the foregoing equations (1) and (2), while the transverse wave component $E_\theta$ of an electric field is inversely proportional to the distance (namely, distance attenuation of the transverse wave component $E_\theta$ is small), the longitudinal wave component $E_R$ includes no radiation electric field.

Figure 6:
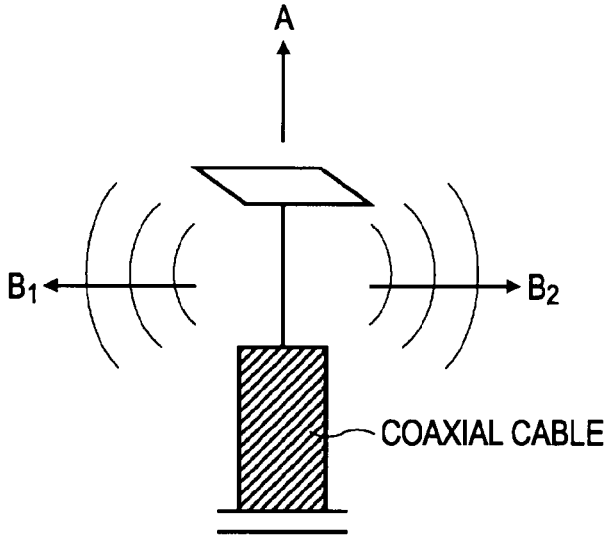
FIG. 6 is a diagram illustrating an example of a structure of a capacity loaded antenna.

First, in order to prevent the transverse wave component $E_\theta$ from occurring, it is necessary to prevent the high-frequency coupler from functioning as an antenna. The high-frequency coupler shown in FIG. 2 appears to have a structure similar to that of a "capacity loaded antenna" in which metal is attached to the tip of an antenna element, thereby inducing a capacitance and reducing the height of the antenna. Therefore, it is necessary to prevent the high-frequency coupler from functioning as the capacity loaded antenna. While an example of a structure of the capacity loaded antenna is illustrated in FIG. 6, mainly the longitudinal wave component $E_R$ of an electric field arises in a direction indicated by an arrow A and the transverse wave component $E_\theta$ of an electric field arises in directions indicated by arrows $B_1$ and $B_2$, in FIG. 6.

In the example of a structure of the coupling electrode, shown in FIG. 3, the dielectric 15 and the through-hole 16 play the role of avoiding the coupling between the coupling electrode 14 and the ground 18 and the role of forming the series inductor 12. By having a sufficient height from the circuit mounting surface of the printed circuit board 17 to the electrode 14 to form the series inductor 12, the electric-field coupling between the ground 18 and the electrode 14 is avoided, and an electric field coupling action between the coupling electrode and a high-frequency coupler at a receiver end is ensured. Note that, when the height of the dielectric 15 is large, that is, the distance from the circuit mounting surface of the printed-circuit board 17 to the electrode 14 is of such a length relative to the operating wavelength that it is difficult to ignore, the high-frequency coupler operates as a capacity loaded antenna and the transverse wave component $E_\theta$ arises in directions indicated by arrows $B_1$ and $B_2$ in FIG. 6. Therefore, the height of the dielectric 15 is determined on the basis of the following conditions:

the coupling between the electrode 14 and the ground 18 is avoided while the characteristics as the high-frequency coupler are fully achieved;

the length of the dielectric 15 is large enough to form the series inductor 12, which is necessary for the function of an impedance matching circuit; and the length of the dielectric 15 is small enough to suppress the emission of unnecessary electric waves $E_\theta$ due to electric current flowing in the series inductor 12.

On the other hand, from the above equation (2), it turns out that the longitudinal wave component $E_R$ reaches a maximum when an angle θ between the direction of the infinitesimal dipole and the longitudinal wave component $E_R$ is zero degrees. Therefore, in order to perform noncontact communication by using the longitudinal wave component $E_R$ of an electric field efficiently, it is desirable to transmit a high-frequency electric field signal under the condition in which a high-frequency coupler at a communication partner side is placed opposite the high-frequency coupler at a transmitter so that the angle θ between the direction of the infinitesimal dipole and the direction from the high-frequency coupler at a transmitter end toward the high-frequency coupler at a receiver end is nearly zero degrees.

In addition, the resonance section including the series inductor 12 and the parallel inductor 13 causes the electric current of a high-frequency signal flowing into the coupling electrode 14 to be amplified. As a result, the moment of the infinitesimal dipole formed by both electric charge accumulated in the coupling electrode 14 and mirror electric charge at the ground can be increased and a high-frequency electric field signal including the longitudinal wave component $E_R$ can be emitted efficiently in a propagation direction whose angle θ with respect to the direction of the infinitesimal dipole is nearly zero degrees.

In the high-frequency coupler shown in FIG. 2, the operating frequency $f_0$ of the impedance matching section is determined by a constant $L_1$ of the parallel inductor and a constant $L_2$ of the series inductor. However, a lumped constant circuit usually has a lower frequency band than a distributed constant circuit, in a high-frequency circuit, and a constant of an inductor becomes small when the frequency is high. Therefore, owing to the variation of constants, there occurs a problem in which a resonance frequency becomes out of alignment. In contrast, there is considered a solution in which a wider bandwidth is achieved by configuring the high-frequency coupler by using distributed constant circuits as substitute for lumped constant circuits, in the impedance matching section and the resonance section.

Figure 7:
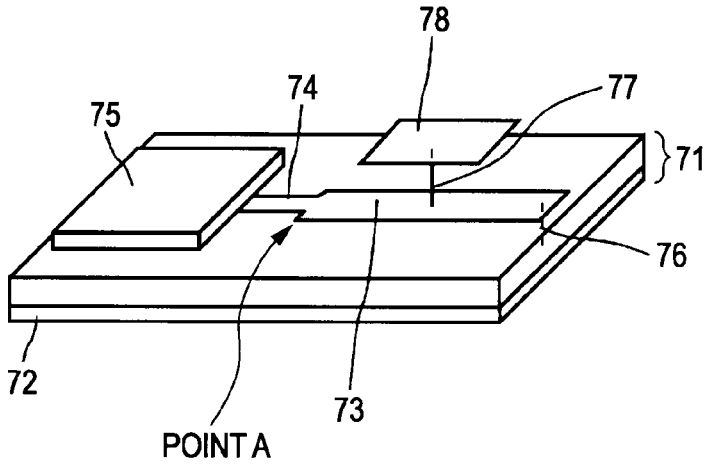
FIG. 7 is a diagram illustrating an example of a structure of a high-frequency coupler which uses a distributed constant circuit in a resonance section.

In FIG. 7, an example of a structure of the high-frequency coupler which uses distributed constant circuits in the impedance matching section and the resonance section is illustrated. In the example shown in FIG. 7, while a ground conductor 72 and a printed pattern are formed on a lower surface and an upper surface of a printed-circuit board 71 respectively, a high-frequency coupler is disposed on the printed-circuit board 71. As the impedance matching section and the resonance section in the high-frequency coupler, a microstrip line or a coplanar waveguide, namely a stub 73, is formed as substitute for a parallel inductor and a series inductor, the stub 73 functioning as a distributed constant circuit and being connected to a transmitting and receiving circuit module 75 through a signal line pattern 74. The stub 73 is connected to the ground 72 on the lower surface through a through-hole 76 which penetrates through the printed-circuit board 71 at the leading end of the stub 73, so that the stub 73 is shorted. In addition, a portion near the center of the stub 73 is connected to a coupling electrode 78 through a single terminal 77 including a thin metallic wire.

In addition, "stub" described in the field of electronics is a general term for electric wires one ends of which are connected and the other ends of which have no connection or are connected to ground. Then, the stub is arranged in the middle of a circuit in order to perform adjustment, measurement, impedance matching, or filtering or the like.

Figure 8:
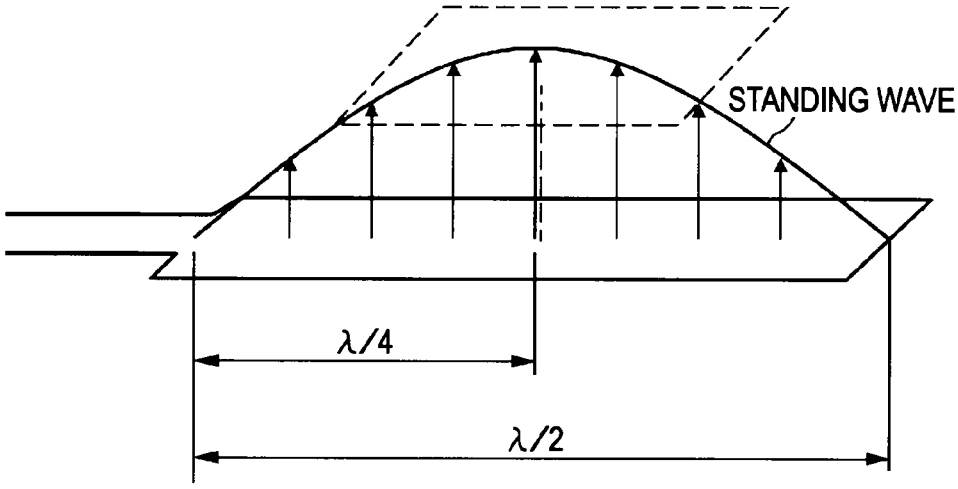
FIG. 8 is a diagram illustrating a state in which a standing wave arises on a stub in the high-frequency coupler shown in FIG. 7.

Here, a signal input from the transmitting and receiving circuit through the signal line is reflected at the leading end of the stub 73 and whereby a standing wave stands in the stub 73. A phase length of the stub 73 is set to one-half of the wavelength of the high-frequency signal (180 degrees in phase), and the signal line 74 and the stub 73 are formed by using a microstrip line or a coplanar or the like on the printed-circuit board 71. As shown in FIG. 8, when the leading end of the stub 73 is shorted under the condition in which the phase length of the stub 73 corresponds to one-half of the wavelength, the voltage magnitude of the standing wave arising in the stub 73 becomes zero at the leading end of the stub 73 and reaches a maximum in the middle of stub 73, namely at one-quarter of the wavelength (90 degrees) from the leading end of the stub 73. By using the single terminal 77 to connect the coupling electrode 78 and a portion near the center of the stub 73, where the voltage magnitude of the standing wave reaches the maximum, a high-frequency coupler which has high propagation efficiency can be fabricated.

The stub 73 shown in FIG. 7 is a microstrip line or a coplanar waveguide on the printed-circuit board 71. Then, since the direct-current resistance of the stub 73 is small, a loss in the high-frequency signal is small and a propagation loss between high-frequency couplers can be reduced. In addition, since the size of the stub 73 included in the distributed constant circuit is large enough to correspond to one-half of the wavelength of the high-frequency signal, dimension errors due to manufacturing tolerances are far smaller than the entire phase length and it is difficult for the variation of characteristic to occur.

The basic structure of the high-frequency coupler corresponds to the example in which the coupling electrode having mushroom configuration is placed above the resonance section such as the stub and connected to the stub by using the metallic wire, as shown in FIG. 7. However, when, as shown in FIG. 7, the coupling electrode is supported only by a linear member, the mechanical strength is insufficient and it is easy for deformation to occur. For example, when downward overload is applied to the upper surface of the coupling electrode, a supporting member is bent and is not restored to the original shape.

On the other hand, as shown in FIG. 3, when the spacer 15 including a dielectric (insulating material) supports the coupling electrode 14, the mechanical strength increases and the probability of deformation of the coupling electrode 14 decreases. However, cost increase is expected. In addition, at the time when the spacer 15 is formed with resin, if the electric permittivity of the resin is large, an operating frequency band of the high-frequency coupler is narrowed. Furthermore, if the dielectric tangent of the resin is large, there occurs the problem in which loss increases and the coupling strength of the high-frequency coupler becomes weak.

A high-frequency coupler which has a favorable electric characteristic corresponds to a structure in which, as shown in FIG. 7, the coupling electrode 78 is not supported by a spacer. Therefore, it is desirable to implement easily, at low cost, and in an undeformable shape, a high-frequency coupler having a structure in which the coupling electrode 78 is not supported by a spacer.

Figure 9A:
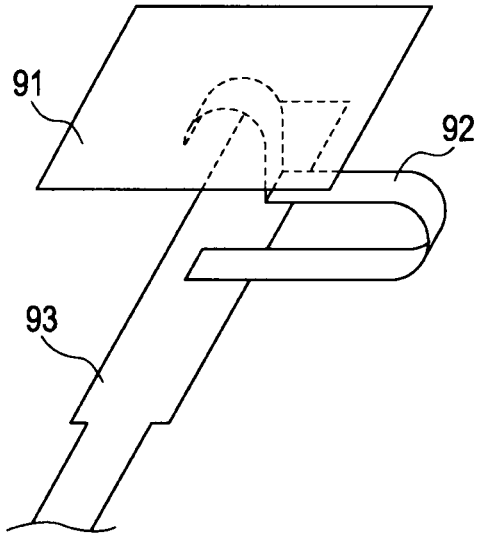
FIG. 9A is a diagram illustrating an example of a structure of a high-frequency coupler in which a coupling electrode is supported by a shield finger and connected to a resonance section (stub)
Figure 9B:
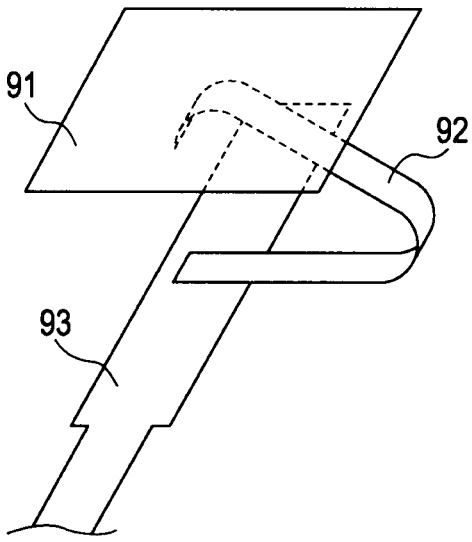
FIG. 9B is a diagram illustrating an example of a structure of a high-frequency coupler in which a coupling electrode is supported by a shield finger and connected to a resonance section (stub)

The inventor of the present invention proposes, as an example of a supporting structure which is resistant to deformation, a structure in which a coupling electrode 91 is supported by a shield finger 92 and connected to a resonance section (stub) 93, as shown in FIGS. 9A and 9B. Namely, a shield finger is a small chip part which is casted in a leaf spring-shape, and is widely used as a small contact maker. While usual shield fingers have various shapes, the shield finger described in the embodiment is a shield finger of a type in which the cross-section of the shield finger is approximately V-shaped and both ends of the shield finger are open-ended, as shown in figures.

The shield finger 92 supports, at the upper end thereof, the coupling electrode 91, and is connected to the resonance section (stub) 93 at the other end of the shield finger 92. As can be expected from FIGS. 9A and 9B, the shield finger 92 has flexibility in a height direction. For example, when downward load is applied to the upper surface of the coupling electrode 91, the shield finger 92 is deformed and the attitude of coupling electrode 91 changes temporarily. However, when the load is removed, the shield finger 92 is restored to an original state and the attitude of coupling electrode 91 can be restored to an original attitude.

Figure 10A:
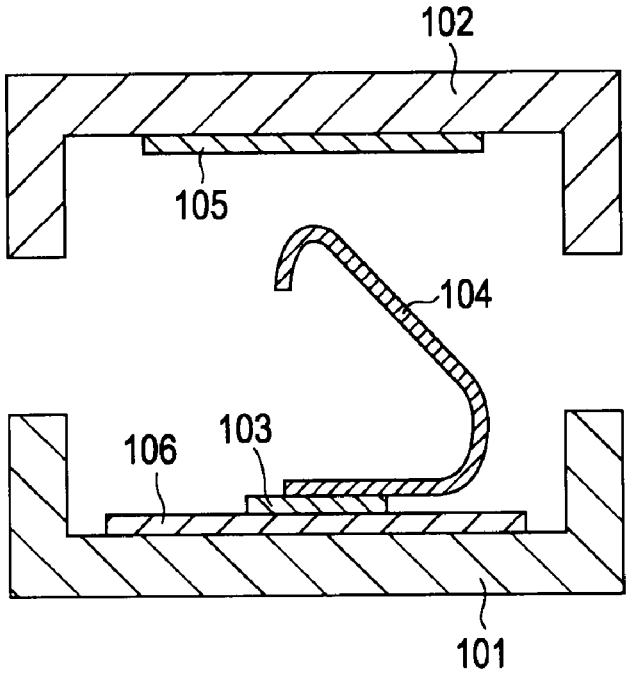
FIG. 10A is a diagram illustrating an example of implementation which uses a basic structure of a high-frequency coupler in which a coupling electrode is supported by a shield finger.
Figure 10B:
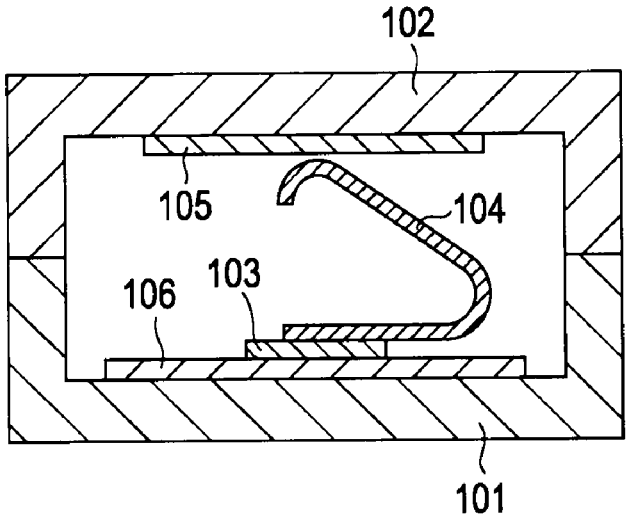
FIG. 10B is a diagram illustrating an example of implementation which uses a basic structure of a high-frequency coupler in which a coupling electrode is supported by a shield finger.

In FIGS. 10A and 10B, an example of implementation which uses a basic structure of the high-frequency coupler in which, as shown in FIGS. 9A and 9B, the coupling electrode is supported by the shield finger is illustrated. In the example shown in the figures, the high-frequency coupler is arranged in the chassis of a portable device including a first housing member 101 and a second housing member 102.

A circuit board 106, on the surface of which a conductor pattern or the like is implemented as the resonance section (stub) 103, is attached to the inner surface of the first housing member 101. It is assumed that a ground pattern (not shown) is implemented on the rear surface of the circuit board 106, for example. The lower end of the shield finger 104 is attached to a predetermined portion of the resonance section (stub) 103. In addition, for example by using plating or the like, a conductor pattern which functions as a coupling electrode 105 is formed on the inner surface of the second housing member 102.

As shown in FIG. 10A, under the condition in which the second housing member 102 is disengaged from the first housing member 101 (namely, the condition in which the chassis of the portable device is taken apart), the upper end of the shield finger 104 is connected nowhere and turns out to be open-ended. In contrast, as shown in FIG. 10B, under the condition in which the second housing member 102 is attached to the first housing member 101 and the openings of the first housing member 101 and the second housing member 102 are closed (namely, the condition in which the chassis of the portable device is assembled), the upper end of the shield finger 104 has direct contact with the coupling electrode 105 formed on the inner surface of the second housing member 102. As a result, the coupling electrode 105 is supplied with electric power through the shield finger 104 and electric charge is accumulated in the coupling electrode 105. Therefore, the longitudinal wave component of an electric field is emitted owing to the action described with reference to FIG. 4.

Figure 11:
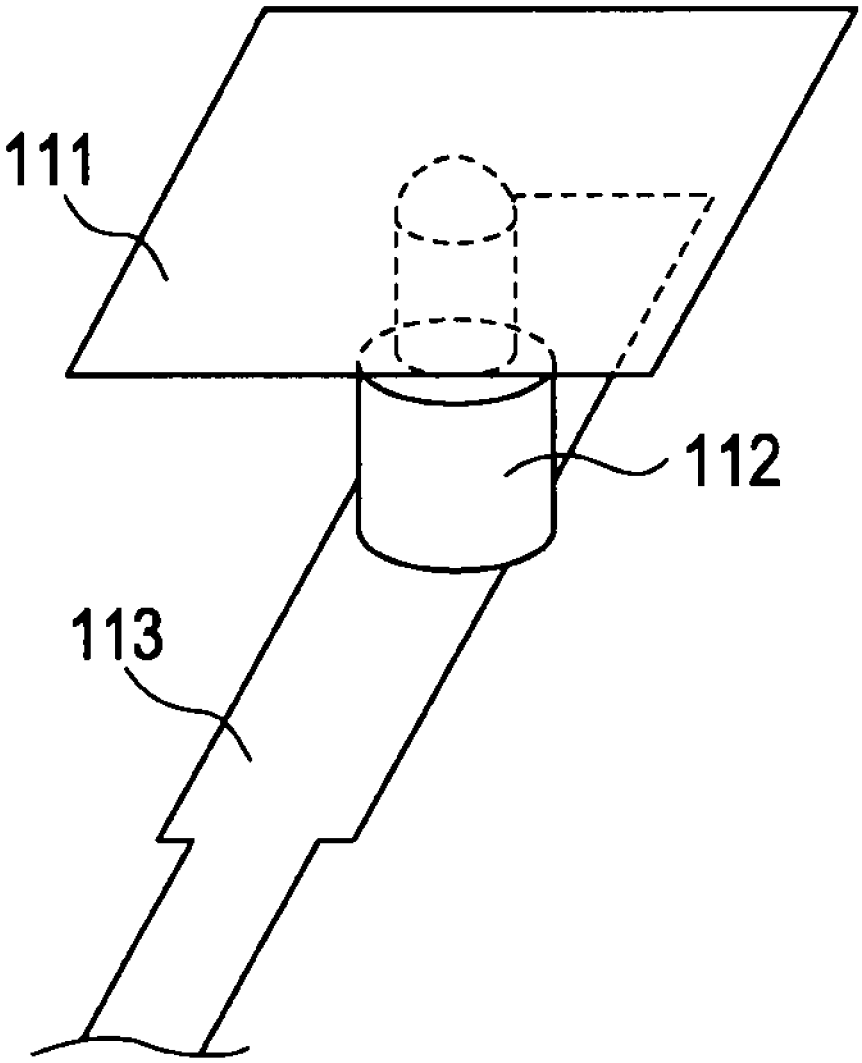
FIG. 11 is a diagram illustrating an example of a structure of a high-frequency coupler in which a coupling electrode is supported by a pogo pin and connected to a resonance section (stub)

In addition, the inventor of the invention proposes, as another example, a structure in which a coupling electrode 111 is supported by a pogo pin 112 and connected to a resonance section (stub) 113, as shown in FIG. 11. Here, the pogo pin is a kind of movable probe pin the leading end of which is stretched and retracted owing to a spring as a spring-loaded pin. Namely, usually, the pogo pin is used as a connector used for connecting two circuit boards or a connector used for a battery terminal.

The upper end of the pogo pin 112 supports the coupling electrode 111 and the other end of the pogo pin 112 is connected to the resonance section (stub) 113. As can be expected from FIG. 11, the pogo pin 112 is a structure which is stretchable and retractable in the height direction thereof owing to the elasticity of a spring provided in the pogo pin 112. For example, when downward load is applied to the upper surface of the coupling electrode 111, the pogo pin 112 is retracted and the coupling electrode 111 is retracted temporarily. However, when the load is removed, the spring provided in the pogo pin 112 is restored to an original state and the coupling electrode 111 can be restored to an original height.

Figure 12A:
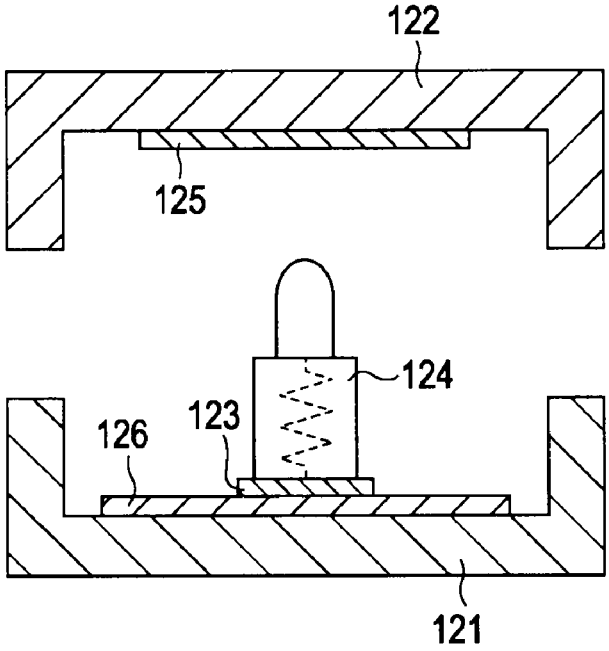
FIG. 12A is a diagram illustrating an example of implementation which uses a basic structure of a high-frequency coupler in which a coupling electrode is supported by a pogo pin.
Figure 12B:
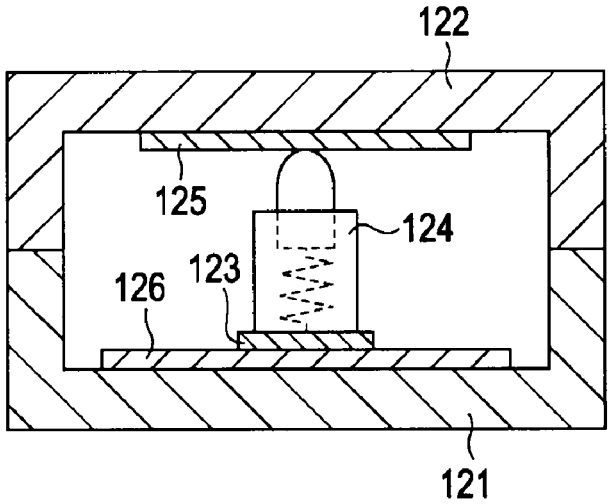
FIG. 12B is a diagram illustrating an example of implementation which uses a basic structure of a high-frequency coupler in which a coupling electrode is supported by a pogo pin.

In FIGS. 12A and 12B, an example of implementation which uses a basic structure of the high-frequency coupler in which the coupling electrode is supported by the pogo pin is illustrated. In the example shown in the figures, the high-frequency coupler is arranged in the chassis of a portable device including a first housing member 121 and a second housing member 122.

A circuit board 126, on the surface of which a conductor pattern or the like is implemented as the resonance section (stub) 123, is attached to the inner surface of the first housing member 121. It is assumed that a ground pattern (not shown) is implemented on the rear surface of the circuit board 126, for example. The lower end of the pogo pin 124 is attached to a predetermined portion of the resonance section (stub) 123. In addition, for example by using plating or the like, a conductor pattern which functions as a coupling electrode 125 is formed on the inner surface of the second housing member 122.

As shown in FIG. 12A, under the condition in which the second housing member 122 is disengaged from the first housing member 121 (namely, the condition in which the chassis of the portable device is taken apart), the upper end of the pogo pin 124 is separated from the first housing member 121 and turns out to be open-ended. In contrast, as shown in FIG. 12B, under the condition in which the second housing member 122 is attached to the first housing member 121 and the opening of the first housing member 121 and the second housing member 122 are closed (namely, the condition in which the chassis of the portable device is assembled), the upper end of the pogo pin 124 has direct contact with the coupling electrode 125 formed on the inner surface of the second housing member 122. As a result, the coupling electrode 125 is supplied with electric power through the pogo pin 124 and electric charge is accumulated in the coupling electrode 125. Therefore, the longitudinal wave component of an electric field is emitted owing to the action described with reference to FIG. 4.

As described with reference to FIGS. 9 to 12, by adopting a structure in which the coupling electrode is supported by using a member such as the shield finger or the pogo pin, the high-frequency coupler can be configured in a small size and at a low price and be suitably incorporated in a handheld device. In addition, in order to prevent the emission of unnecessary electric waves from increasing as a capacity loaded antenna (refer to FIG. 6), it is necessary for the coupling electrode to be supported so that the coupling electrode is separately placed at an adequate height from the circuit board (ground). Therefore, by putting the two housing members together so that the openings of the two housing members are closed, the coupling electrode is supported at a desired height. In addition, since the shield finger and the pogo pin, which are used for supporting and connecting the coupling electrode, are stretchable and retractable, it is difficult for the supporting member to be bent and destroyed even if a load is applied to the supporting member through the housing member.

Next, the performance characteristic in the case in which the shield finger supports the coupling electrode will be compared with the performance characteristic in the case in which the pogo pin supports the coupling electrode.

Figure 13:
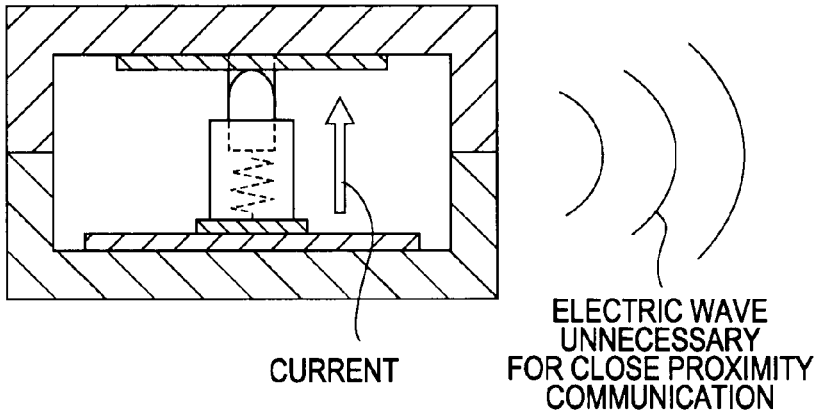
FIG. 13 is a diagram illustrating a state in which electric power is supplied to a coupling electrode through a pogo pin under the condition in which a second housing member is attached to a first housing member and the openings of the first housing member and the second housing member are closed.

FIG. 13 is a diagram illustrating a state in which electric power is supplied to the coupling electrode 125 through the pogo pin 124 under the condition in which the second housing member 122 is attached to the first housing member 121 and the openings of the first housing member 121 and the second housing member 122 are closed (namely, the condition in which the chassis of the portable device is assembled). As shown in FIG. 13, when electric current flows on the surface of the pogo pin 124 in the vertical direction in FIG. 13, the electric current causes a transverse wave component of an electric field to emit in a direction which is perpendicular to the direction of the electric current, namely in the horizontal direction in FIG. 13, as shown in FIG. 6. The transverse wave is an electric wave which is unnecessary for close proximity wireless transfer.

Figure 14:
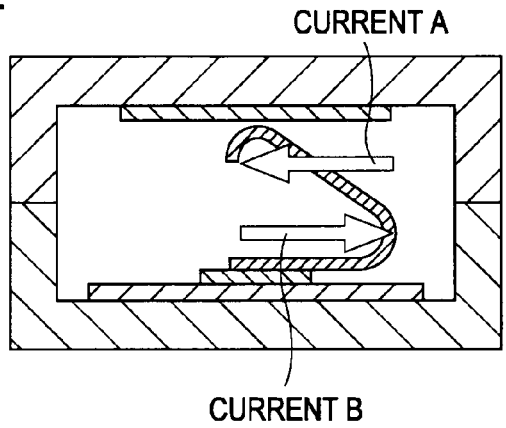
FIG. 14 is a diagram illustrating a state in which electric power is supplied to a coupling electrode through a shield finger under the condition in which a second housing member is attached to a first housing member and the openings of the first housing member and the second housing member are closed.

In addition, FIG. 14 is a diagram illustrating a state in which electric power is supplied to the coupling electrode 105 through the shield finger 104 under the condition in which the second housing member 102 is attached to the first housing member 101 and the openings of the first housing member 101 and the second housing member 102 are closed (namely, the condition in which the chassis of the portable device is assembled). In the embodiment, there is used the shield finger 104 which is a shield finger of a type in which the cross-section of the shield finger is approximately V-shaped and both ends of the shield finger are open-ended, as shown in the figure. Therefore, when electric power is supplied from the lower end of the shield finger 104, electric current flows to the upper end of the shield finger 104 along the leaf spring whose cross-section is approximately V-shaped. At this time, since electric current A flows along one leg portion of the V-shaped shield finger 104 in one approximately horizontal direction in FIG. 14 and electric current B flows along the other leg portion of the V-shaped shield finger 104 in another approximately horizontal direction in FIG. 14, which is approximately opposite to the direction of the electric current A, the action of the electric current A and the action of the electric current B cancel each other out. Therefore, an electric wave which is unnecessary for close proximity wireless transfer can be suppressed.

Figure 15:
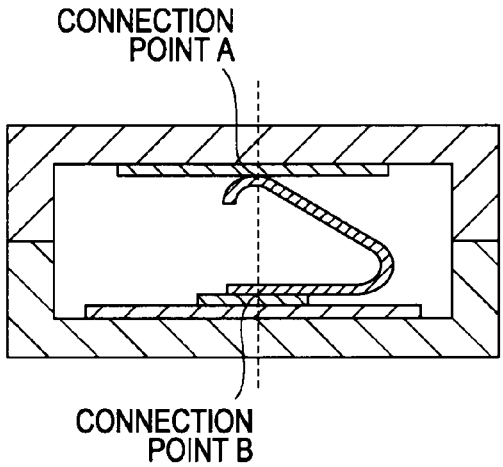
FIG. 15 is a diagram illustrating an example of most suitable arrangement of a contact point (connection point B) between a resonance section in the first housing member and a lower end of the shield finger and a contact point (connection point A) between an upper end of the shield finger and the coupling electrode.

In order to fulfill the action which cancels out influences of the electric current flows which flow along the leaf spring as described above, it is desirable for the upper end of the shield finger 104 to have contact with the coupling electrode 105 at a position (connection point A) which is located approximately immediately above (namely, in the vertical direction in FIG. 15) a contact point (connection point B) between the resonance section 103 in the first housing member 101 and the lower end of the shield finger 104, as shown in FIG. 15.

Figure 16A:
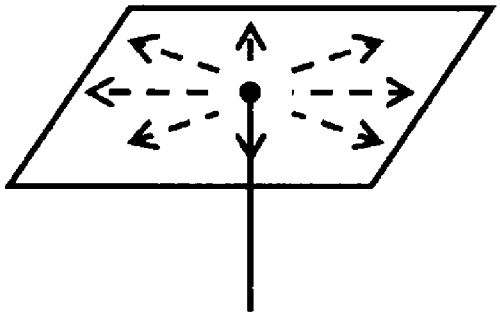
FIG. 16A is a diagram illustrating a state in which electric current flows flow in the coupling electrode when a power feeding point is arranged at the center of the coupling electrode.
Figure 16B:
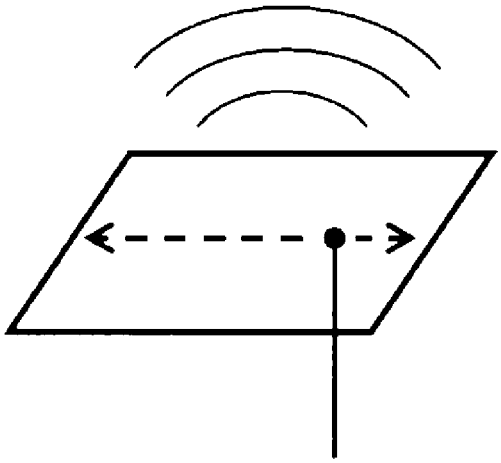
FIG. 16B is a diagram illustrating a state in which, when a power feeding point is arranged at an offset position away from the center of the coupling electrode, uneven electric current flows flow in the coupling electrode and an unnecessary electric wave is emitted.

In addition, even though either the pogo pin or the shield finger is used as a supporting member used for the coupling electrode, it is desirable to locate a power feeding point approximately in the center of the coupling electrode. This is because, owing to the position offset of the power feeding point, electric current flows on the surface of the coupling electrode and unnecessary electric wave arises. By feeding electric power approximately into the center of the coupling electrode, the longitudinal wave component $E_R$ of an electric field can reach a maximum (refer to FIG. 16A). In contrast, when the power feeding point is located at the offset position from the center of the coupling electrode, a electric current component which flows in a direction parallel to the coupling electrode increases, owing to the position offset of the power feeding point (refer to FIG. 16B). Therefore, a transverse wave component $E_\theta$ in the front direction of the coupling electrode increases in response to the electric current component.

Next, miniaturization and height lowering when the shield finger is used as a supporting member used for the coupling electrode will be considered.

Figure 17A:
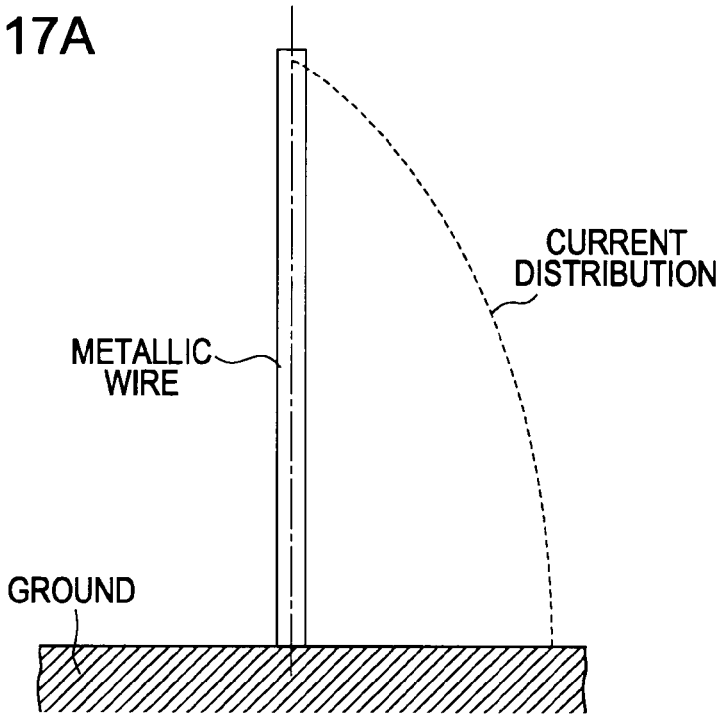
FIG. 17A is a diagram used for explaining a resonance phenomenon at a monopole antenna.

The capacity loaded antenna shown in FIG. 6 corresponds to a shape used for lowering the height of a monopole antenna. Usually, when a metallic wire whose length corresponds to one-quarter of the wavelength of an operating frequency is set up to be vertical to the ground, the metallic wire resonates at the operating frequency and electric current distribution as shown in FIG. 17A arises. As shown in FIG. 17A, since further electric current does not flow at the leading end of the metallic wire, the electric current distribution at the leading end turns out to be zero (namely, a node whose amplitude is zero). On the other hand, at the power feeding point which is the root of the metallic wire, the electric current distribution turns out to be maximum (namely, an antinode whose amplitude is maximum).

Figure 17B:
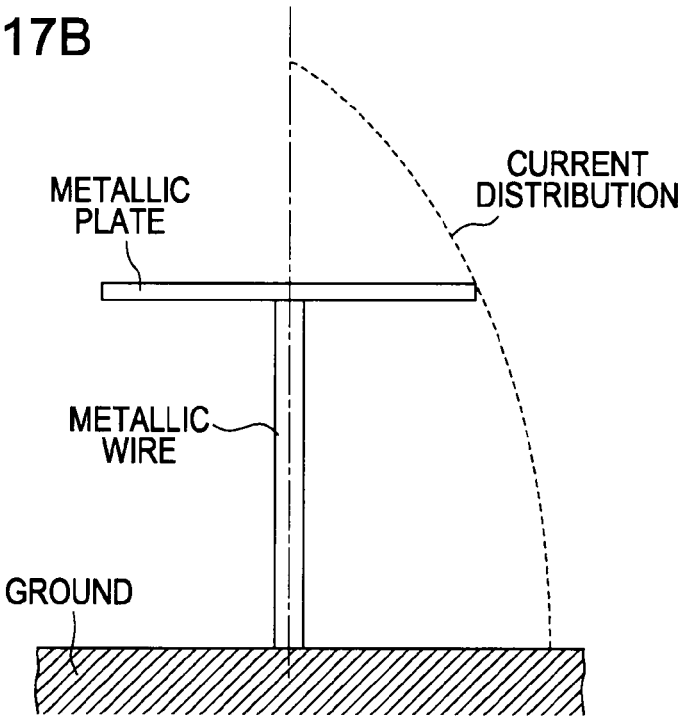
FIG. 17B is a diagram used for explaining a resonance phenomenon at a capacity loaded antenna.
Figure 17C:
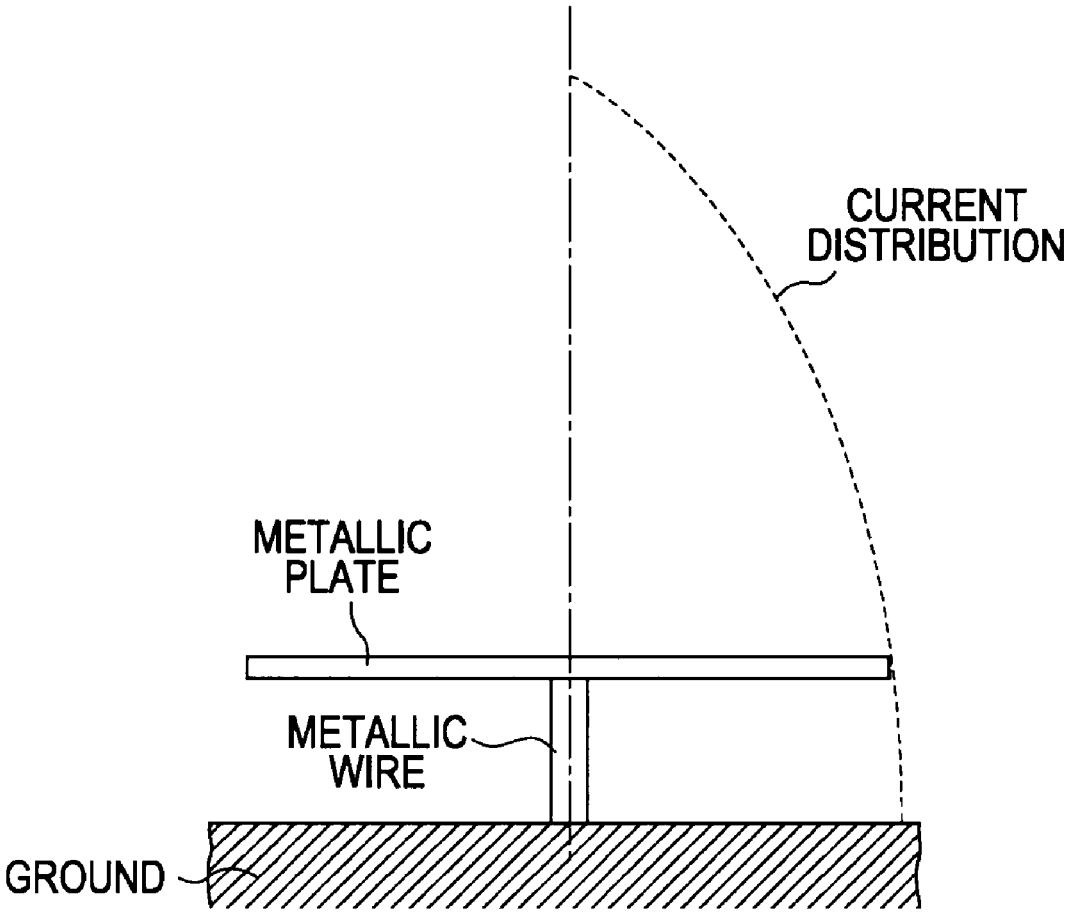
FIG. 17C is a diagram used for explaining a resonance phenomenon at a capacity loaded antenna.

Here, when, as shown in FIG. 17B, the height of the metallic wire is lowered and a metallic plate is attached to the leading end of the metallic wire, the metallic wire and the metallic plate function as a capacity loaded antenna which is similar to the capacity loaded antenna shown in FIG. 6. At this time, when the combined length of the metallic wire and the metallic plate corresponds to one-quarter of the wavelength of the operating frequency, the metallic wire and the metallic plate can resonate in the same way as the case shown in FIG. 17A. In addition, by widening the metallic plate while maintaining the condition in which the combined length of the metallic wire and the metallic plate corresponds to one-quarter of the wavelength of the operating frequency, the height of the antenna can be further lowered as shown in FIG. 17C.

In this way, the height of the antenna can be lowered by adopting the structure of the capacity loaded antenna. However, since the metallic wire part, which effectively contributes to the emission of an electric wave, turns out to be short, the radiation efficiency (the emission of a transverse wave component of an electric field) of the antenna decreases. However, in order for the metallic wire and the metallic plate to resonate at the operating frequency, it is necessary to set the combined length of the metallic wire and the metallic plate to one-quarter of the wavelength of the operating frequency and hence to further widen the area of the metallic plate in accordance with the shortened length of the metallic wire. Accordingly, the area of the metallic plate becomes large while the height of the high-frequency coupler is lowered.

Figure 18A:
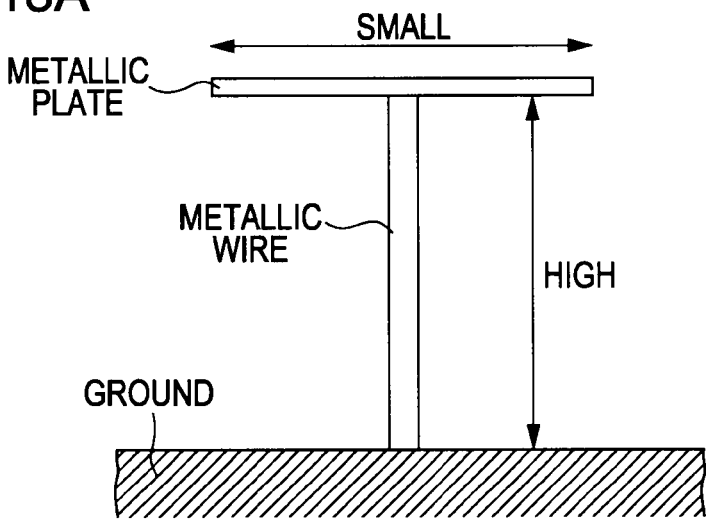
FIG. 18A is a diagram used for explaining a mechanism in which a high-frequency coupler is lowered in height and miniaturized, while maintaining a resonance action in an operating frequency band.
Figure 18B:
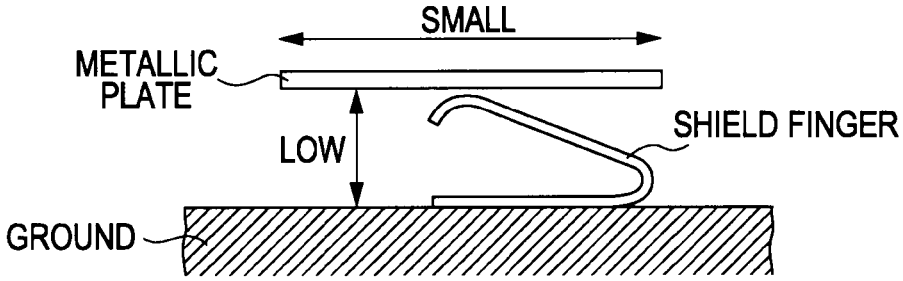
FIG. 18B is a diagram used for explaining a mechanism in which a high-frequency coupler is lowered in height and miniaturized, while maintaining a resonance action in an operating frequency band.
Figure 18C:
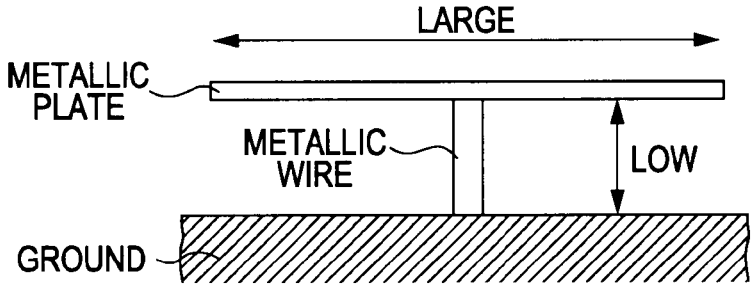
FIG. 18C is a diagram used for explaining a mechanism in which a high-frequency coupler is lowered in height and miniaturized, while maintaining a resonance action in an operating frequency band.

On the other hand, not in the case of the antenna but in the case of the high-frequency coupler, it is desirable to make the emission of an electric wave (a transverse wave component of an electric field) as little as possible and instead, to make the emission of an induction electric field (namely, longitudinal wave component of an electric field) large. Therefore, it is only necessary to suppress the radiation efficiency (the emission of the transverse wave component of an electric field) by further shortening the metallic wire part and to strengthen the emission of an induction electric field (namely, longitudinal wave component of an electric field) by widening the coupling electrode which corresponds to the metallic plate mentioned above (refer to FIG. 18C).

In the case in which the metallic wire part used for supplying electric power to the metallic plate which corresponds to the coupling electrode includes the shield finger as shown in FIG. 9 or 10, even though the height of the metallic plate is the same, the metallic wire can be lengthened owing to the V-shaped cross-section of the shield finger. This can be understood by comparing FIG. 18A with FIG. 18B. In addition, since it is only necessary for the combined length of the metallic wire and the metallic plate to correspond to one-quarter of the wavelength of the operating frequency, the area of the metallic plate can be made smaller in accordance with the length of the metallic wire, which is lengthened owing to the V-shaped bent shape, compared with the case in which the metallic wire does not have a bent shape (refer to FIGS. 18B and 18C).

While, usually, capacity loading and bending of an emission element or the like are used as techniques used for miniaturizing an antenna, radiation efficiency of the antenna decreases in exchange for miniaturization, in any one of the techniques. In contrast, since, in close proximity wireless transfer, it is desirable to suppress the emission of an unnecessary electric wave, both miniaturization and characteristic improvement of the high-frequency coupler can be achieved at the same time by applying a miniaturization technique, which is similar to a miniaturization technique for an antenna, to the high-frequency coupler.

The present application contains subject matter related to that disclosed in Japanese Priority Patent Application JP 2009-156301 filed in the Japan Patent Office on Jun. 30, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A high-frequency coupler comprising:

ground;

a coupling electrode configured to be supported so that the coupling electrode is placed opposite the ground and separately placed at a height from the ground, the height being negligible with respect to the wavelength of a high-frequency signal;

a resonance section configured to increase electric current which enters the coupling electrode through a transmission path; and a stretchable and retractable connection section configured to connect a predetermined position on the coupling electrode and the resonance section;

wherein an infinitesimal dipole is formed, the infinitesimal dipole including a line segment which connects the center of electric charge accumulated in the coupling electrode and the center of mirror electric charge accumulated in the ground, and the high-frequency signal is transmitted to another high-frequency coupler at a communication partner side, which is placed opposite the high-frequency coupler so that the angle θ between the direction of the infinitesimal dipole and the direction from the high-frequency coupler toward the other high-frequency coupler is nearly zero degrees.

2. The high-frequency coupler according to claim 1, wherein the connection section includes a leaf spring whose cross-section is approximately V-shaped, the connection section is connected to the coupling electrode by using one end of the leaf spring, and the connection section is connected to the resonance section by using the other end of the leaf spring.

3. The high-frequency coupler according to claim 1, wherein the cross-section of the connection section includes a pogo pin, the cross-section is connected to the coupling electrode by using one end of the pogo pin, and the connection section is connected to the resonance section by using the other end of the pogo pin.

4. The high-frequency coupler according to any one of claims 2 and 3, wherein a circuit board where the ground and the resonance section are implemented is arranged on an inner surface of a first housing member of a portable device, and one end of the connection section is attached to the resonance section; and a conductor pattern, which functions as the coupling electrode, is formed on an inner surface of a second housing member of the portable device.

5. The high-frequency coupler according to claim 4, wherein the other end of the connection section has direct contact with the predetermined position on the coupling electrode and the resonance section is connected to the coupling electrode, in the state in which the first housing member is closed by using the second housing member and a chassis is assembled.

6. The high-frequency coupler according to claim 2, wherein with respect to the connection section, the one end of the leaf spring whose cross-section is approximately V-shaped is placed approximately immediately above the other end of the leaf spring and connected approximately to the center of the coupling electrode.

7. The high-frequency coupler according to claim 2, wherein the combined length of the leaf spring and the coupling electrode approximately corresponds to a quarter of the wavelength of an operating frequency.

8. A communication device comprising:

ground;

a coupling electrode configured to be supported so that the coupling electrode is placed opposite the ground and separately placed at a height from the ground, the height being negligible with respect to the wavelength of a high-frequency signal;

a resonance section configured to increase electric current which enters the coupling electrode through a transmission path;

a stretchable and retractable connection section configured to be attached to the resonance section by using one end of the stretchable and retractable connection section and to connect a predetermined position on the coupling electrode and the resonance section;

a first housing member configured to include a circuit board where the ground and the resonance section are implemented and which is arranged on an inner surface of the first housing member; and a second housing member configured to include a conductor pattern which functions as the coupling electrode and is formed on an inner surface of the second housing member;

wherein the other end of the connection section has direct contact with the predetermined position on the coupling electrode and the resonance section is connected to the coupling electrode, in the state in which the first housing member is closed by using the second housing member; and an infinitesimal dipole is formed, the infinitesimal dipole including a line segment which connects the center of electric charge accumulated in the coupling electrode and the center of mirror electric charge accumulated in the ground, and the high-frequency signal is transmitted to another high-frequency coupler at a communication partner side, which is placed opposite a high-frequency coupler so that the angle θ between the direction of the infinitesimal dipole and the direction from the high-frequency coupler toward the other high-frequency coupler is nearly zero degrees.

* * * * *